United States Patent [19]

Pater

[11] 3,955,222

[45] May 11, 1976

[54] EASY RISE BED VIBRATOR DEVICE

[76] Inventor: Raymond J. Pater, 522 Archer Ave., McKeesport, Pa. 15132

[22] Filed: Jan. 3, 1975

[21] Appl. No.: 538,339

[52] U.S. Cl. ..... 5/109; 128/33

[51] Int. Cl.[2] ..... A47D 9/02

[58] Field of Search ..... 5/108, 109, 317 R; 128/33

[56] References Cited

UNITED STATES PATENTS

| | | | |
|---|---|---|---|
| 761,862 | 6/1904 | Wallman et al. | 5/317 R |
| 1,293,102 | 2/1919 | Humphrey | 5/317 R |
| 2,869,538 | 1/1959 | Hawk | 5/108 |
| 3,056,145 | 10/1962 | McKinley et al. | 5/109 |

*Primary Examiner*—Casmir A. Nunberg
*Attorney, Agent, or Firm*—William J. Ruano

[57] ABSTRACT

A vibrator device intended to be mounted to the frame of a bed to provide a soothing vibratory action to the bed for slowly and gently nudging an individual sleeping in the bed from slumber to an awake condition, the vibrator having an electrically operated motor connected to an eccentric shaft weighted to produce a shaking vibratory motion with the free end of the shaft being rotatably secured in a pillow block type bearing. A clock mechanism with a dial indicator is provided for mounting on the bed for control of the electric motor.

1 Claim, 2 Drawing Figures

EASY RISE BED VIBRATOR DEVICE

BACKGROUND OF THE INVENTION

1. Field of the Invention

This invention relates to a vibrating device for a bed to provide a quiet and gentle vibration to the bed for gently nudging an individual sleeping in the bed into an awake body condition.

2. Description of the Prior Art

It is well known that bells, alarms, buzzers and the like are quite irritating to a sleeper when used to wake the sleeper, such as on clock alarm devices, with the sleeper normally being awakened in a rude and harsh manner thereby and thus normally being quite irritable during the early morning hours.

It would thus be desirable to provide a device that would gently and slowly nudge an individual from the condition of sleeping to the condition of wakefulness in a pleasing manner to help provide a more pleasing start for the day.

SUMMARY OF THE INVENTION

The present invention recognizes the need for the gentle awakening of an individual from a sleeping condition, and provides a novel solution thereto in the form of a vibrator device intended to be mounted to the bed frame for vibrating the same and controlled by means of a clock mechanism.

A further feature of the present invention provides a bed vibrating device to provide a pleasing and relaxing vibratory motion to the bed both to put the individual resting in the bed to sleep at night as well as to gently awake the individual in the morning as the vibrator is clock controlled.

The features and advantages of this invention will be readily apparent during the course of the following description.

BRIEF DESCRIPTION OF THE DRAWINGS

In the accompanying drawings forming a part of this specification, and in which like reference characters are employed to designate like parts throughout the same.

DESCRIPTION OF THE PREFERRED EMBODIMENT

Figure 1:
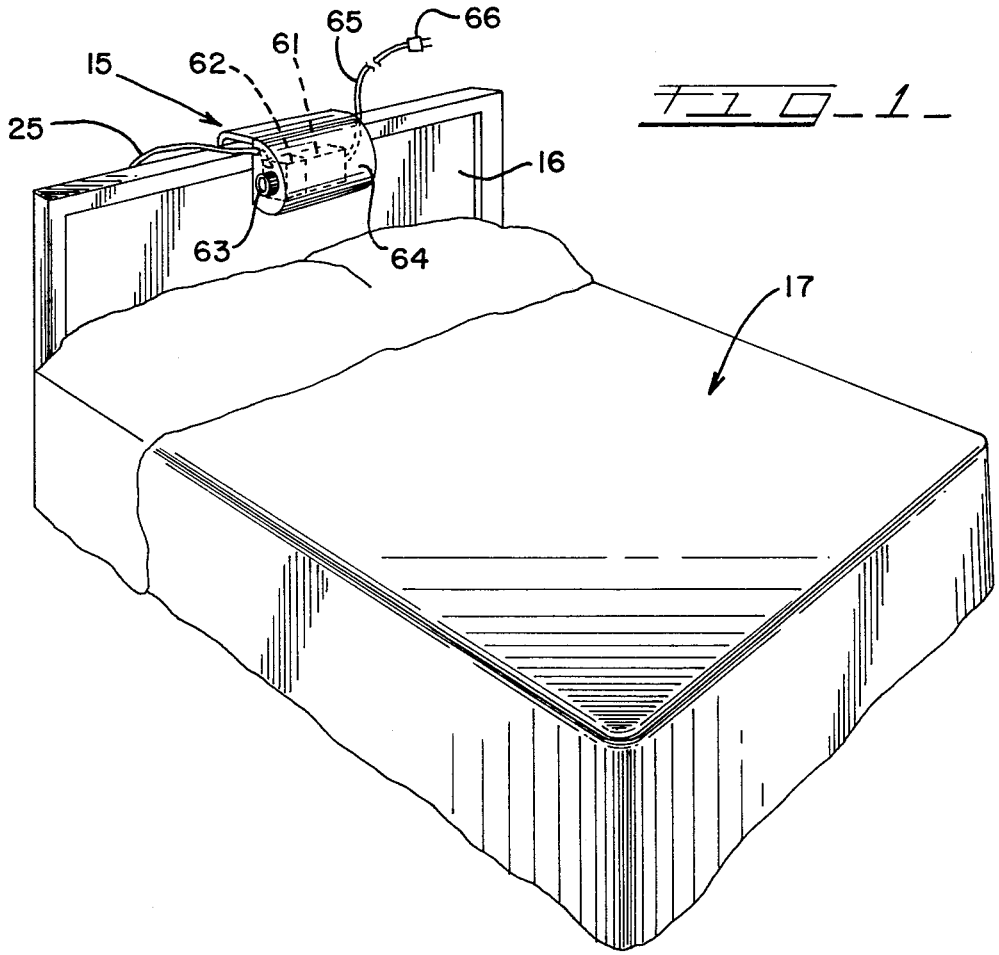
FIG. 1 is a perspective view of a bed having the vibratory device of the present invention mounted thereto.
Figure 2:
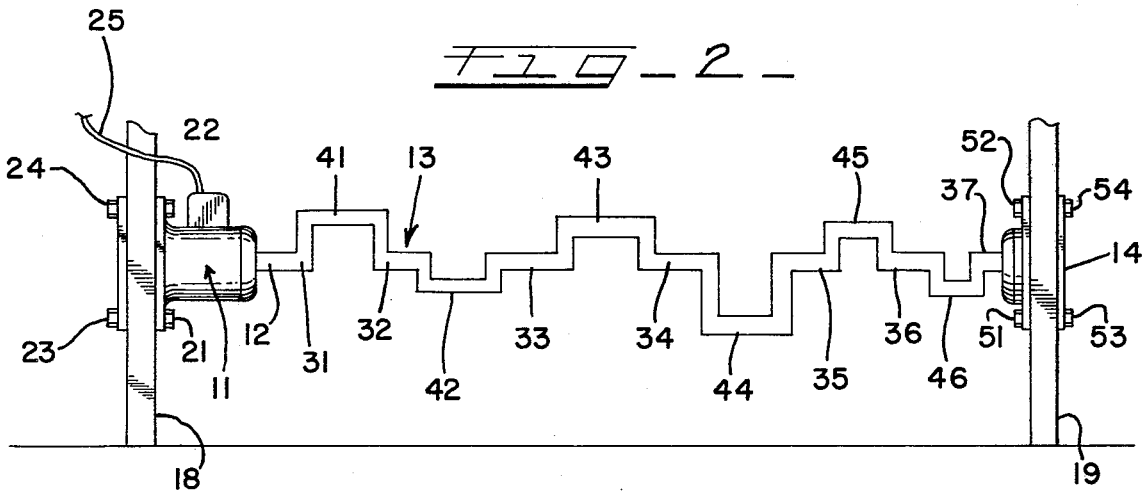
FIG. 2 is an end elevational view of the bed frame illustrating the vibratory device of the invention mounted thereto.

Referring now to the drawings in detail there is illustrated a preferred form of the easy rise bed vibrator device constructed in accordance with the principles of the present invention and which is designated generally in its entirety by the reference numeral 10 and which consists of electric motor 11 having its shaft 12 connected to one end of eccentric shaft 13, pillow block bearings 14 rotatively receiving the free end of eccentric shaft 13 and clock operated timing mechanism 15 adapted to be removably mounted to the headboard 16 of bed 17 having longitudinally extending side rails 18 and 19.

The motor 11 is mounted by bolts 21 and 22 secured by nuts 23 and 24 to side rail 18 in a manner extending outwardly normal thereto. The motor 11 is provided with an electrical cord 25 having one end electrically connected to the motor with its opposite end connected to clock mechanism 15.

The shaft or rod 13 includes main longitudinally extending portions 31–37 and radially outwardly spaced eccentric portions 41–46. Eccentric portion 41 is disposed between rod portions 31 and 32, eccentric portion 42 is disposed between rod portions 32 and 33, eccentric portion 43 is disposed between rod portions 33 and 34, eccentric portion 44 is disposed between rod portions 34 and 35, eccentric portion 45 is disposed between rod portions 35 and 36, and eccentric portion 46 is disposed between rod portions 36 and 37. The free end of rod portion 37 is rotatably received in pillow block bearing 14 which is secured to side frame 19 by means of bolts 51 and 52 and nuts 53 and 54.

Clock mechanism 15 includes electrically operated clock 61 and associated electrical switch contact 62 which are settable by means of dial 63 extending outwardly of clock mechanism housing 64 to provide for the timed operation of electric motor 11. Electrical cord 65 extends outwardly of housing 64 and terminates in electric plug 66 adapted to be plugged into a conventional household outlet to provide electrical energy to the vibrator device 10.

In operation, an individual resting in bed 17 sets clock mechanism 61 by means of dial 63 to the desired time to be awakened, and when the desired time arrives clock mechanism 61 activates contact 62 in a manner to energize motor 11 effecting rotation of shaft 13 with eccentric portions 41–46 providing a vibrating movement to the bed 17. In this manner an individual resting in bed 17 would be awakened in a quiet, slow and gentle manner.

It is envisioned that in addition to clock 61 being settable to merely awaken an individual, it is envisioned that a slumber provison may be provided in the clock so that an individual may activate motor 11 to provide a gentle vibrating and soothing movement to the bed to assist the individual in going to sleep, with the clock then shutting off the motor 11 until the preset time to awaken the individual, at which time contact 62 again energizes motor 11 to vibrate the bed and awaken the individual sleeping therein.

It is to be understood that the form of this invention as shown and described is a preferred example thereof, and that this invention is not limited to the specific arrangement disclosed or described or illustrated as it is envisioned that various changes in the details of construction as to shape, size and arrangement of parts may be made without departing from the spirit or scope of the invention or of the claims.

Having described the invention, what I claim is:

1. An easy rise bed vibrator device intended for mounting on a bed having side rails supporting a mattress thereon, the vibrator device comprising, in combination, an electric motor adapted to be mounted on one of the side rails of the bed on the inner side thereof facing the other side rail, bearing means adapted to be mounted on the opposite side rail of the bed in alignment with a shaft of said motor, an eccentric shaft having one end affixed to said motor shaft and having its opposite end rotatably mounted in said bearing means, said eccentric shaft comprising a series of axially aligned and longitudinally elongated rod members each interconnected by radially outwardly extending asymmetrical eccentric members disposed at longitudinal spaced apart positions therealong, a clock mechanism adapted to be mounted on a portion of said bed within easy reach of an individual resting in said bed for selective control of said motor, suitably insulated wire means interconnecting said motor and said clock mechanism, and suitably insulated electric wires having one end connected to said clock mechanism with their opposite ends terminating in a conventional standard electric plug adapted to be plugged into a conventional source of household electricity.

* * * * *